US005331912A

United States Patent [19]

Clark

[11] Patent Number: 5,331,912

[45] Date of Patent: Jul. 26, 1994

[54] SELF-RELEASING MAST BASE COLLAR

[76] Inventor: Brian Clark, 15914 Juanita Dr. NE., Kenmore, Wash. 98011

[21] Appl. No.: 947,562

[22] Filed: Sep. 21, 1992

[51] Int. Cl.[5] ..... B63B 15/00

[52] U.S. Cl. ..... 114/90

[58] Field of Search ..... 114/89-91, 114/39.2, 93; 403/108, 107, 106

[56] References Cited

U.S. PATENT DOCUMENTS

| | | | |
|---|---|---|---|
| 3,507,240 | 4/1970 | Butler | 114/90 X |
| 3,704,850 | 12/1972 | Hendrickson et al. | 403/108 X |
| 4,586,399 | 5/1986 | Kassai | 403/108 X |

FOREIGN PATENT DOCUMENTS

| | | | |
|---|---|---|---|
| 2576276 | 7/1986 | France | 114/39.2 |

OTHER PUBLICATIONS

Yasuoka Marine Co., Ltd., Shredder, (catalog & 1991 calendar) 1990.

Photographs of prior art mast base collars are enclosed & identified as follows in the same order as discussed in background portion of application: #1-Windsurfing Hawaii, Version 1; #2-Gorge Technology; #3—Windsurfing Hawaii, Version 2; and #4—Neil Pryde.

*Primary Examiner*—Sherman Basinger

*Attorney, Agent, or Firm*—Graybeal Jackson Haley & Johnson

[57] ABSTRACT

A windsurfer mast base collar which has a a collar supporting a pair of spring loaded detents that are self-releasing upon application of modest upward manual forces and self-engaging upon application of downward mast securing forces upon an upper load bearing surface of the collar. The relative positions of the force bearing elements of the collar and the mast base to which it is attached results in the detents being subjected primarily to compressive loads.

18 Claims, 1 Drawing Sheet

SELF-RELEASING MAST BASE COLLAR

BACKGROUND

The invention relates generally to apparatus associated with mast supports for sailing vessels and particularly to windsurfer mast base collars.

Dependent upon various sail sizes, it is preferable to adjust the height of a windsurfer mast. A windsurfer mast typically is a hollow metal or composite tube. The mast is slipped over a mast base which is fixed to the windsurf board. An arrangement of pulleys, jam cleats and lines are used to secure the sail, which pulls on the mast inside the sail, to the mast base.

Most mast bases have an adjustable collar fitted around them that can be releasably locked into a number of different height positions on the mast base. The lower end of the mast rests upon the collar thus determining the mast height.

There are a number of variations of mast base collars in the prior art. An early design is a simple collar which receives the ends of a steel pin into one of two pairs of notches in the interior periphery of the lower edge of the collar. The pin passes through the mast base via one set of a series of diametrically opposed hole pairs. The hole pairs are spaced vertically above one another to facilitate positioning the mast at the height desired. The disadvantage to this arrangement is that the pin can easily be lost in the water or on a sandy beach because it is independent of the collar itself. Furthermore, adjustment of the mast height demands the use of two hands on the collar and the pin. Also, the placement of the pin at a different height often proves frustrating since careful alignment of the pin through the hollow mast is required to position the pin in an opposing hole.

An improvement on the previously described prior art is very similar. The pin is tethered by a short cord to the collar to prevent loss, and the pin is retained in the hole pair by a recess in the lower edge of the collar running around the entire interior circumference. But the problem of two handed adjustment remains along with the task of threading the pin through the hole pairs.

Another improvement on the previously described apparatus eliminates the pin. The collar is connected by hinges to a pair of downward directed arms. Each arm has an interior protrusion that passes through a hole in the collar and then engages a height adjustment hole on each side of the mast base. The pins pass the load in shear from the holes in the collar to the holes in the mast base. The device is disengaged by applying manual pressure to a secondary interior ring that elastically deforms to retract the arms. One drawback to this device is that both compression forces to deform the ring and vertical displacement forces must be applied at the same time to readjust the collar.

For another variant, the collar supports a single leaf spring with a protrusion on the interior side that engages a height adjustment hole. The collar then slides down over the leaf spring to lock the protrusion in place. A disadvantage to this apparatus is the necessity to raise the collar and mast approximately three quarters of an inch to unlock the leaf spring, and, to set the collar, the mast must be extended three quarters of an inch beyond the desired location to engage the mast and collar then retract this three quarters of an inch before force can be applied.

In a further variation, the collar supports two arcuate spring biased levers that pivot about two vertically disposed pins retained by the collar. Each lever has a protrusion that engages a hole in the mast base. A drawback to this apparatus is that each lever must be independently biased away from an engaged position with a finger and, at the same time, a vertical displacement force must be applied to the collar to adjust it to a new position.

In still another variant, the collar supports two semicircular yokes. The yoke ends are supported by a pair of diametrically opposed horizontal hinge pins retained by the collar. Each yoke has an inward extending protrusion at the midpoint of its length. The yokes are spring biased to urge the protrusions into a pair of height adjustment holes. When a downward load on the mast and sail is exerted upon the collar, the geometry of the active and resultant force vectors creates a force couple that tends to rotate the yokes into a locked position. There are several disadvantages to this apparatus. First, to balance the vertical loads, the geometry of the apparatus generates significant force components in the horizontal plane. Those excessive horizontal forces require that the structure of the collar, yokes and the mast base be heavier gauge materials than would be necessary if the horizontal force components were lower. Secondly, the yokes are subjected to high level tensile forces which can deform the yokes from their preferred semicircular shape. Thirdly, the hinge pins must transfer the high horizontal force components so they too must be of a heavier gauge than would otherwise be required. Lastly, the upper surface of the detent pin, which causes the pin to retract when an upward force is applied to the collar, takes on an angle which is unfavorable to the release movement when the detent swings out of position.

SUMMARY OF TEE INVENTION

The present invention is an improved windsurfer mast base collar. It comprises a collar supporting a pair of spring loaded detents that are self-releasing upon application of modest upward manual forces and self-engaging upon application of downward mast securing forces upon an upper surface of the collar.

In use, the invention only requires the user to employ one hand to adjust the height of the collar. Fingertip pressure applied to the collar is sufficient to disengage the collar from a particular position. There is no need to manually pry the detents from their respective engaged positions because the geometry of the load carrying elements provides adequate disengagement forces to overcome spring forces tending to bias the detent into an engaged position.

The close proximity of the pivot position of the detents and the engagement position in the mast base, being above and outboard of the pivot position, results in very low horizontal force components. An advantage of the low horizontal forces permits the use of lighter weight components. Also, the position of the detent pivot, being above the engagement point, subjects the detent element to compression forces only. Another advantage of the invention is that the moving parts are more compact than in several of the prior art designs which aids in weight reduction and makes them less susceptible to fouling. A further advantage is that the upper surface of the detent pin, which causes the pin to retract when an upward force is applied to the collar, can be made with a cylindrical shape without causing resistance to release as, when the detent swings out of position.

FIG. *2a* is a side elevation view of the swing pin element of the invention illustrating engagement loads.

FIG. *2b* is a side elevation view of the swing pin element of the invention illustrating disengagement loads.

Figure 1:
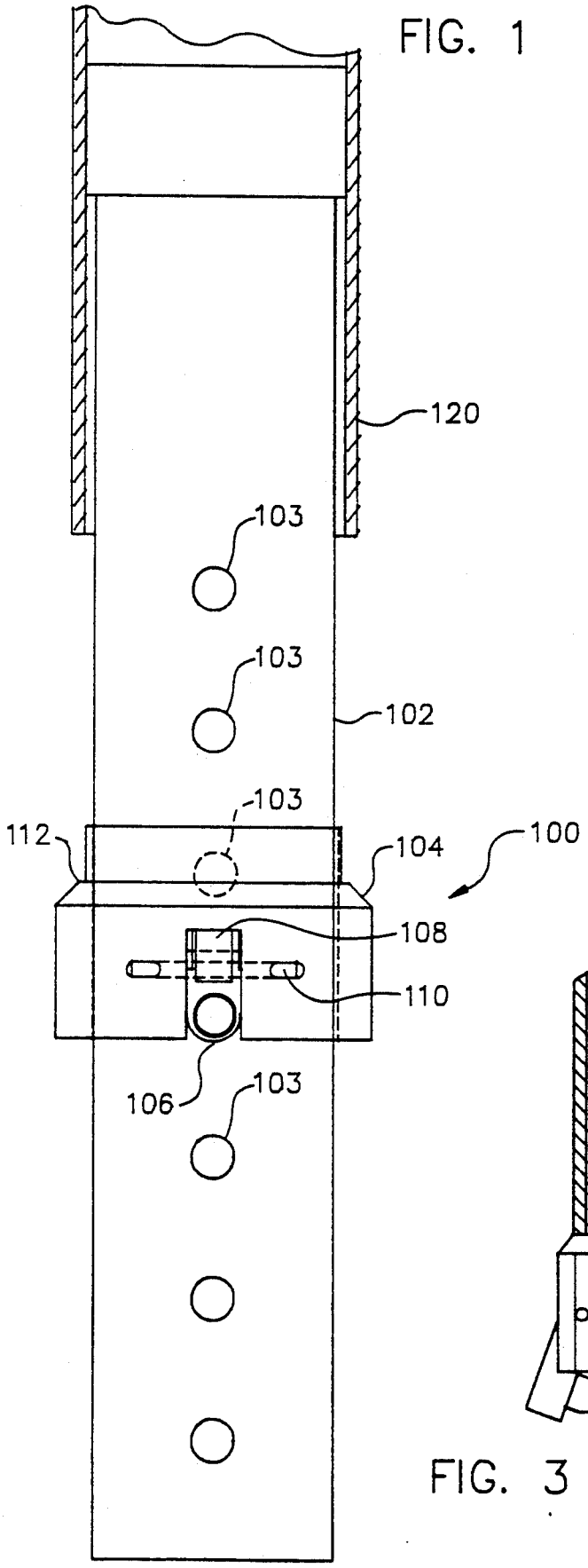
FIG. 1 is an elevation view of the invention mounted upon a mast base.
Figure 2A:
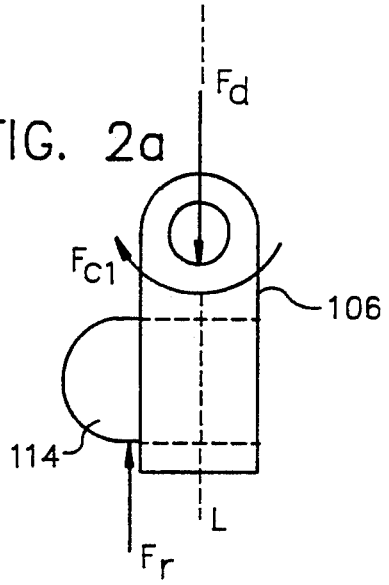
Figure 2B:
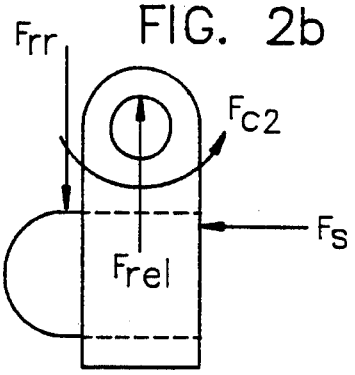
Figure 3:
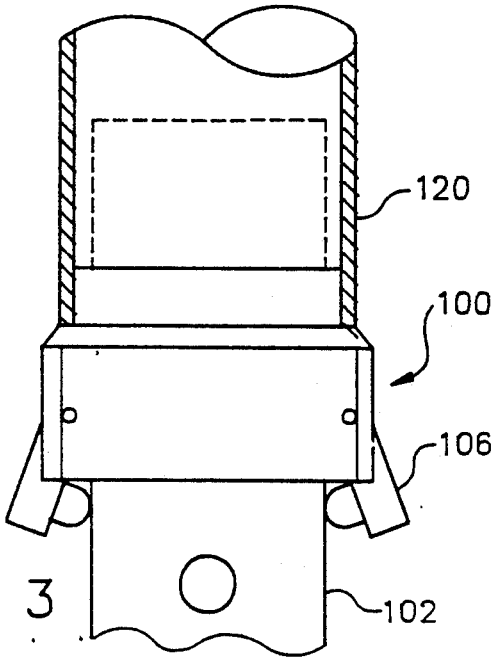

FIG. 3 is an orthogonal elevation view of the invention as shown in FIG. 1 wherein the invention is disengaged from a mast base.

DETAILED DESCRIPTION OF A PREFERRED EMBODIMENT

FIG. 1 shows the mast base collar 100 in place upon a vertical mast base 102. The mast base features a series of diametrically opposed height adjustment holes 103. The collar 100 comprises ring 104, swing pin 106, spring 108 and hinge pin 110. There are identical elements 106, 108 and 110 opposite those shown in FIG. 1. Since the opposing elements operate in the same manner, the function of the device will be described relative to one set of those elements.

Ring 104 supports the transversely mounted hinge pin 110. Swing pin 106 rotates in a vertical plane about the hinge pin 110. Spring 108, which is mounted to ring 104 by a screw or similar fastener or by a protrusion of spring material into a hole in the collar, exerts a weak force on the swing pin 106 that biases the swing pin towards the mast base 102.

Vertically downward forces exerted by the lower end of the mast 120 upon the collar are borne by the downward force bearing surface 112. Downward forces are transferred through the hinge pin 110 to the swing pin 106. The downward forces are opposed and balanced by a reaction force exerted upon swing pin 106 by mast base 102 at the point of contact in holes 103.

FIG. *2a* is a side view of swing pin 106 illustrating the distribution of engaging or locking forces upon the swing pin 106. Downward force vector "$F_d$" is substantially collinear with the longitudinal axis "L" of the swing pin. The reaction force vector "$F_r$" exerted by the mast base through contact with the edge of a hole 103 (not shown) bears upon detent 114. The combination of the two force vectors results in a force couple "$F_{c1}$" that urges the swing pin towards an engaged position.

FIG. *2b* is a side view of swing pin 106 illustrating the distribution of releasing or disengagement forces upon the swing pin. When the mast securing forces are released, thus removing the majority of the downward forces depicted by vector $F_d$ in FIG. *2a*, the collar 100 may be disengaged by manually applying a minimal upward force to the collar. The upward release force, shown as vector "$F_{rel}$", is transferred to the swing pin 106 through the hinge pin. Upon contact with the upper edge of a hole 103 in mast base 102 (neither shown) a release reaction force "$F_{rr}$" bears upon detent 114. The combination of these forces results in a force couple "$F_{c2}$" which urges the swing pin away from an engaged position and has a sufficient horizontal component to overcome the weak bias force of spring 108 "$F_s$" which serves to hold the detent 114 in position in holes 103 until engaging or release forces are applied to the collar.

I claim:

1. A mast base collar, comprising:

circular support means for supporting a mast and surrounding and affixing to a mast base; and compressive means, attached to the support means by a hinge, for transmitting a compressive force from the support means at the hinge through the compressive means to engage the mast base.

2. The mast base collar of claim 1 wherein the compressive means comprises an arm connected to the hinge at one end and having a protrusion on a second end which engages a hole in the mast base.

3. The mast base collar of claim 1, wherein the compressive means releases from engagement of the mast base when upward forces are exerted upon the collar means relative to the mast base.

4. The mast base collar of claim 1, wherein the compressive means comprises:

a lower force bearing surface which engages the mast base and an upper force bearing surface which bears on the support means at the hinge, such that a downward force from the support means to the upper force bearing surface and a resulting downward force from the lower force bearing surface to the mast base results in a force couple tending to rotate the compressive means into an engaged position against the mast base; and a release force bearing surface, such that a pulling force acting on the upper force bearing surface as a result of an upward pulling force transmitted by the hinge and a reaction force acting upon the release force bearing surface results in a force couple which rotates the compressive means into disengagement from the mast base.

5. A mast base collar, comprising:

support means for supporting a mast and affixing to a mast base; and compressive means, bearing against the support means, for transmitting a compressive force from the support means through the compressive means to the mast base, wherein the force exerted on the compressive means by the support means causes the compressive means to be urged against the mast base, and the compressive means releases from engagement of the mast base when upward forces are exerted upon the collar relative to the mast base.

6. The mast base collar of claim 5 wherein the compressive means comprises an arm connected to the support means by a hinge at one end of the arm and having a protrusion on a second end which engages a hole in the mast base.

7. A mast base collar, comprising:

circular support means for supporting a mast and surrounding and affixing to a mast base; and an arm, attached at one end of the arm to the support means, by a hinge, which arm extends downward from the hinge and engages the mast base with a second end of the arm, and which arm carries the load from the support means at the hinge through the arm to the mast base.

8. The mast base collar of claim 7 wherein the arm has a protrusion on the second end which engages a hole in the mast base.

9. The mast base collar of claim 7, wherein the arm releases from engagement of the mast base when upward forces are exerted upon the support means relative to the mast base.

10. The mast base collar of claim 7, wherein the arm comprises:

a lower force bearing surface which engages the mast base and an upper force bearing surface which bears on the support means at the hinge, such that a downward force from the support means to the upper force bearing surface and a resulting downward force from the lower force bearing surface to the mast base results in a force coupled tending to rotate the arm into an engaged position against the mast base; and a release force bearing surface, such that a pulling force acting on the upper force bearing surface as a result of an upward pulling force transmitted by the hinge and a reaction force acting upon the release force bearing surface results in a force couple which rotates the arm into disengagement from the mast base.

11. A mast base collar, comprising:

support means for supporting a mast and affixing to a mast base; and an arm attached at one end of the arm to the support means by a hinge, and which arm extends downward from the hinge and engages the mast base at a second end, and which arm releases from engagement of the mast base when upward forces are exerted upon the support means relative to the mast base.

12. The mast base collar of claim 11 wherein the arm has a protrusion on the second end which engages a hole in the mast base.

13. The mast base collar of claim 11 wherein the force exerted on the arm by the support means causes the arm to be urged against the mast base.

14. A mast base collar, comprising:

support means for supporting a mast and affixing to a mast base; and compressive means, bearing against the support means, for transmitting a compressive force from the support means through the compressive means to the mast base by engaging the mast base, and which compressive means releases from engagement of the mast base when upward forces are exerted upon the support means relative to the mast base.

15. The mast base collar of claim 14 wherein the compressive means comprises an arm connected to the support means by a hinge at one end of the arm and having a protrusion on a second end of the arm which protrusion engages a hole in the mast base.

16. The mast base collar of claim 14 wherein the force exerted on the compressive means by the support means causes the compressive means to be urged against the mast base.

17. The mast base collar of claim 5, further comprising a second compressive means, like the first compressive means, affixed to the support means at the opposite side from the first compressive means, which second compressive means shares with the first compressive means the load from the support means.

18. The mast base collar of claim 10, further comprising a second arm, like the first arm, affixed to the support means at the opposite side from the first arm, which second arm shares with the first arm the load from the support means.

* * * * *